US005665268A

United States Patent [19]

DeGuertechin et al.

[11] Patent Number: 5,665,268

[45] Date of Patent: *Sep. 9, 1997

[54] NEAR TRICRITICAL POINT COMPOSITIONS

[76] Inventors: Louis Oldenhove DeGuertechin, Meerstraat 2, B-3870, Heks; Guy Broze, Rue Claskin, 32, B-4460, Grace-Hollogne, both of Belgium

[ * ] Notice: The term of this patent shall not extend beyond the expiration date of Pat. No. 5,527,486.

[21] Appl. No.: 304,621

[22] Filed: Sep. 12, 1994

Related U.S. Application Data

[63] Continuation-in-part of Ser. No. 191,892, Feb. 4, 1994, abandoned.

[51] Int. Cl.[6] ..... C11D 7/50

[52] U.S. Cl. ..... 510/214; 510/235; 510/342; 510/337

[58] Field of Search ..... 252/142, 143, 252/162, 170, 173, 174.21, 174.25, DIG. 8, DIG. 14

[56] References Cited

U.S. PATENT DOCUMENTS 5,108,643 4/1992 Loth et al. ..... 252/174.11

FOREIGN PATENT DOCUMENTS 2194547 3/1988 European Pat. Off. .

*Primary Examiner*—Ponnathapura Achutamurthy

[57] ABSTRACT

The present invention relates to an aqueous cleaning composition which is useful for the removal of grease or tar without any mechanical action. In particular, the instant compositions are derived from three liquid phases which merge together at the tricritical point to form one continuum forming the aqueous cleaning composition, wherein the three phases incorporate at least a polar solvent, a non-polar solvent or weakly polar solvent and a water soluble or water low molecular weight water dispersible amphiphile.

10 Claims, 2 Drawing Sheets

NEAR TRICRITICAL POINT COMPOSITIONS

RELATED APPLICATION

This application is a continuation in part application of U.S. Ser. No. 8/191,892, filed Feb. 4, 1994, now abandoned.

FIELD OF THE INVENTION

The present invention relates to an aqueous, cleaning composition which is optionally surfactant-free and is useful for the removal of grease or tar without any or with a minimum mechanical action. In particular, the instant compositions comprise three liquid phases which merge together in the vicinity of a tricritical point to form one continuum, wherein each of the three phases essentially contain a polar solvent, a non-polar solvent or a weakly polar solvent and a water soluble or water dispersible low molecular weight amphiphile.

BACKGROUND OF THE INVENTION

Liquid aqueous synthetic organic detergent compositions have long been employed for human hair shampoos and as dishwashing detergents for hand washing of dishes (as distinguished from automatic dishwashing, machine washing of dishes). Liquid detergent compositions have also been employed as hard surface cleaners, as in pine oil liquids, for cleaning floors and walls. More recently, they have proven successful as laundry detergents too, apparently because they are convenient to use, are instantly insoluble in wash water, and may be employed in "pre-spotting" applications to facilitate removal of soils and stains from laundry upon subsequent washing. Liquid detergent compositions have comprised anionic, cationic and nonionic surface active agents, builders and adjuvants including, as adjuvants, lipophilic materials which can act as solvents for lipophilic soils and stains. The various liquid aqueous synthetic organic detergent compositions mentioned above serve to emulsify lipophilic materials including oily soils in aqueous media, such as wash water, by forming micellar dispersions and emulsions.

A cleaning action can be regarded as a more-or-less complex process resulting in the removal of soils from a given surface. The driving forces generally involved in this process are mechanical energy (friction, attrition, sonification, etc.), solvation by a liquid, thermal agitation, soil-solvent interfacial tension reduction, chemical modifications (caustic, acidic, oxidative, reductive, hydrolysis, assisted or not by catalysts or enzymes), soil or soil residual suspension (e.g. in micellar solutions), and so on.

When the cleaning action takes place in water liquid vehicle, auxiliary cleaning agents, especially surfactants, are generally required to get rid of hydrophobic soils. Moreover, in most domestic cleaning tasks, the success of the cleaning mechanism is based on the reduction of the water/oil interfacial tension. The generally admitted theory is that the oily soil is easily dispersed or even solubilized in the composition because of the low interfacial tension existing between the composition and the oil.

Another explanation can be evoked. Due to the low interfacial tension, the liquid detergent composition easily diffuses through the soil or between the support and the soil, thereby weakening all bonding forces; the soil is then spontaneously removed from the substrate. This is the cause for the removal of oily soil without a real solubilization of the soil which eventually is emulsified. Both mechanisms are complementary in the cleaning process.

Although emulsification is a mechanism of soil removal, it has been recently discovered how to make microemulsions which are much more effective than ordinary emulsions in removing lipophilic materials from substrates. Such microemulsions are described in British Patent Specification No. 2,190,681 and U.S. Pat. Nos. 5,082,584; 5,076,954 and 5,108,643 most of which relates to acidic microemulsions useful for cleaning hard surface items such as bathtubs and sinks, which microemulsions are especially effective in removing soap scum and lime scale from them. In U.S. Pat. No. 5,108,643 the microemulsions may be essentially neutral and as such are also thought to be effective for microemulsifying lipophilic soils from substrates. In U.S. Pat. No. 4,919,839 there is described a light duty microemulsion liquid detergent composition which is useful for washing dishes and removing greasy deposits from them in both neat and diluted forms. Such compositions include complexes of anionic and cationic detergents as surface active components of the microemulsions.

The various microemulsions referred to include a lipophile which may be a hydrocarbon, a surfactant which may be an anionic and/or a nonionic detergent(s), a co-surfactant which may be a poly-lower alkylene glycol lower alkyl ether, e.g. tripropylene glycol monomethyl ether, and water.

Although the manufacture and use of detergent compositions in microemulsion form significantly improves cleaning power and greasy soil removal, compared to the usual emulsions, the present invention improves them still further by the formation of aqueous near tricritical cleaning compositions which have improved cleaning as compared to microemulsions.

The instant aqueous cleaning compositions, which are optionally surfactant-free, provide increased grease and tar removal capabilities without mechanical action as compared to the water-based microemulsions as disclosed in U.S. Pat. Nos. 5,075,026; 5,106,643; 4,919,839 and 5,082,584. These water-based microemulsions all contain a surfactant as compared to the preferred surfactant-free compositions of the instant invention.

In most domestic cleaning tasks, the success of the cleaning mechanism is based on reduction of the water/oil interfacial tension. In this frame, the thermodynamic of phases predict that ultra-low interfacial tensions can be reached in the direct vicinity of peculiar compositions called "critical points" and particularly near "tricritical points," the properties of which were extensively described by Griffiths (Robert B.) Wheeler (John C.). Critical points in multicomponent systems, Phys. Rev. A, NEW YORK 1970, 2, (3), (Sept.), pp.: 1047–1064; and Griffiths (Robert B.). Thermodynamic model for tricritical points in ternary and quaternary fluid mixtures. J. Chem. Phys., LANCASTER. 1974, 60, (1), pp.: 195–206; and Widom. B. Tricritical points in three- and four-component fluid mixtures J. Phys. Chem., WASHINGTON. 1973, 77, (18), pp.: 2196–2200; and Widom (B.) Interfacial tensions of three fluid phases in equilibrium. J. Chem. Phys. Lancaster, 1975, 62 (4) pp: 1332–13360 and Lang (J. C.) Widom (B.) Equilibrium of three liquid phases and approach to the tricritical point in benzene-ethanol-water-ammonium sulfate mixtures. Physica A, AMSTERDAM. 1975, 81A, pp.: 190–213; and Widom (B.) Three-phase equilibrium and the tricritical point. Kinan, MEXICO. 1981, 3, A, pp.: 143–157

It must be pointed out that, in such critical compositions, surfactants are not a must. Moreover, it is not absolutely essential to be right at a tricritical point to obtain surface tensions much lower than those currently achieved with today's cleaning systems.

It is worthwhile to note that the tricritical points theory has already been under high scrutiny in view of enhancing oil recovery. These works are extensively described by Fleming (P. D.) Vinatieri (J. E.). Phase behavior of multicomponent fluids. J. Phys. Chem., WASHINGTON. 1977, 66, (7), pp.: 3147–3154 and Vinatieri (James E.) Fleming (Paul D.). Use of pseudocomponents in the representation of phase behavior of surfactant systems. Soc. Pet. Eng. J., DALLAS, 1979, 19, pp.: 289–300; and Fleming (Paul D.) Vinatieri (James E.). Quantitative interpretation of phase volume behavior of multicomponent systems near critical points. AIChE J., NEW YORK 1979, 25, (3), pp.: 493–502; and Fleming (Paul D.) Vinatieri (James E.). Role of critical phenomena in oil recovery systems employing surfactants. J. Colloid Interface Sci., NEW YORK. 1981, 81, (2), pp.: 319–331; and Vinatieri (James) Fleming (Paul D.), Multivariate optimization of surfactant systems for tertiary oil recovery. Soc. Pet. Eng. J., DALLAS. 1981, (2), pp.: 77–88; and Smith (Duane. H.). Interfacial tensions near the tricritical points of classical liquids: experimental evidence for the validity of the prediction of critical scaling theory. J. Chem. Phys., LANCASTER 1986, 85, PP.: 1545–1558. and Smith (Duane H.). Tricritical points as an aid to the design of surfactants for low-tension enhanced oil recovery. AOSTRA J. Res., EDMONTON(Alberta) 1984, (4), pp: 245–265.

In 1926, Kohnstamm rose the theoretical possibility of a critical point "of the second order" in a ternary liquid mixture, a point at which three co-existing fluid phases merge and become identical, Kohnstamm (Ph.). Handbuch der physik, 1926, Vol. 10, Kap. 4, Thermodynamik der Gemische, pp. 270–271, H. Geiger and K. Scheel (SPRINGER, BERLIN). Kohnstamm also stressed the extreme difficulty to find such a point.

The aqueous cleaning near tricritical point compositions of the instant invention are applicable for use in concentrated household care products and personal care products. The near tricritical point compositions of the instant invention comprise harmless ingredients. The instant near tricritical point compositions permit the preparation of super concentrated cleaning or conditioning liquid products which are optionally surfactant-free.

In accordance with the present invention, a near tricritical point cleaning composition, suitable at room temperature or colder or at a higher temperature for pre-treating and cleaning materials soiled with a lipophilic soil, comprises a polar solvent such as water, a water soluble or dispersible low molecular weight amphiphile, and a non-polar solvent, or weakly polar solvent wherein the three phases have merged into one continuum at the tricritical point. The invention also relates to processes for treating items and materials soiled with soils such as lipophilic soil, with compositions of this invention, to loosen and to remove without mechanical action such soil by applying to the locus of such soil on such material a soil loosening or removing amount of the tricritical point compositions of the instant invention.

The instant aqueous cleaning composition exists at or in the direct vicinity of the tricritical point which is the terminus of three lines of critical points. The tricritical point is a thermodynamical point at which all three co-existing phases become identical simultaneously. At the tricritical point, the interfacial tension between the merging phases of the polar solvent (water) and the low molecular weight amphiphile is substantially zero, and the interfacial tension between the merging phases of the low molecular weight amphiphile and non-polar solvent (oil) or a weakly polar solvent is substantially zero, and the interfacial tension between the polar solvent and the nonpolar or weakly polar solvent is substantially zero. Accordingly, the cleaning mechanism of the cleaning compositions of the instant invention is based on the reduction of the polar solvent/non-polar solvent interfacial tension as it approaches the value of zero.

The compositions of the instant invention have a phase inversion temperature (PIT) of about 0° to about 80° C., more preferably about 15° to about 40° C. The phase inversion temperature is the temperature at which there is an equal affinity of the low molecular weight amphiphile for water and for oil. It is the temperature at which the partition of the low molecular weight amphiphile between the water rich phase and the non-polar solvent phase or weakly polar solvent phase equals unity. That is, the weight fraction of the low molecular weight amphiphile in the water rich phase is equal to the weight fraction of the low molecular weight amphiphile in the non-polar solvent phase.

The tricritical point compositions have $$\text{a ratio } (\alpha) = \frac{\text{wt \% of oil}}{\text{wt \% of water} + \text{wt \% of oil} + \text{wt. \% of additives}}$$

$$\text{and a ratio } (\gamma) = \frac{\text{wt \% of low molecular weight amphiphile}}{\text{100 wt \% of composition}}$$

$$\text{and a ratio } (\epsilon) = \frac{\text{wt \% of additive}}{\text{wt \% of water} + \text{wt. \% of additive}}$$

wherein the weight fraction of the water is equal to $(1-\gamma)(1-\alpha)(1-\epsilon)$ and $\alpha$ is about 0.1 to about 0.9, more preferably about 0.3 to about 0.7, $\gamma$ is about 0.1 to about 0.6, more preferably about 0.2 to about 0.4, and $\epsilon$ is about 0 to about 0.5, more preferably about 0.05 to about 0.25, wherein the additive is a water soluble additive, a polar co-solvent or an electrolyte.

The additives are water soluble molecules (electrolytes or organics) that are able to modify the structure of water so as to strengthen or disrupt the solvent structure. Addition of such chemicals will therefore modify the solubility of uncharged organic ingredients in water and, among others, of amphiphilic molecules. The above chemicals are divided into two classes: Salting-out (or kosmotropic) agents reinforce the structure of water and make it less available to hydrate organic molecules. (Salting-out and -in agents are also referred to as lyotropes and hydrotropes, respectively.) Salting-in (or chaotropic) agents, on the other hand, disorder the structure of water, thereby creating an effect comparable to "holes." As a consequence they increase the solubility of polar organic molecules in water.

In practice, lyotropic agents make water more incompatible with both oil and amphiphile. The result is a decrease of the PIT (with amphiphiles exhibiting a lower consolute point in water such as polyethylene glycol alkyl ethers) and an increase of the supertricritical character. The amount of low molecular weight amphiphile needed to "congregate" water and oil generally increases in the presence of salting-out agents. Hydrotropic agents have the opposite effects.

SUMMARY OF THE INVENTION

The instant invention relates to an aqueous near tricritical point composition having an apparent viscosity at $10^2$ $sec^{-1}$ of about 1 to about 1,000 cps, more preferably about 1 to about 100 cps, and a surface tension of about 10 to about 35 mN/m, which comprises approximately by weight 20 to 50 wt % of a polar solvent; 4 to 55 wt % of a non-polar solvent or a weakly polar solvent, and about 5 to about 60 wt % of water soluble or water dispersible low molecular weight amphiphile.

Accordingly, it is an object of the instant invention to provide an aqueous tricritical point cleaning composition which is useful in a cleaning operation without or with a minimum of mechanical action for the removal of grease and tar and especially for the penetration of the near tricritical composition into a porous surface thereby destroying the adhesion of soil to the substrate.

DETAILED DESCRIPTION OF THE INVENTION

Figure 1:
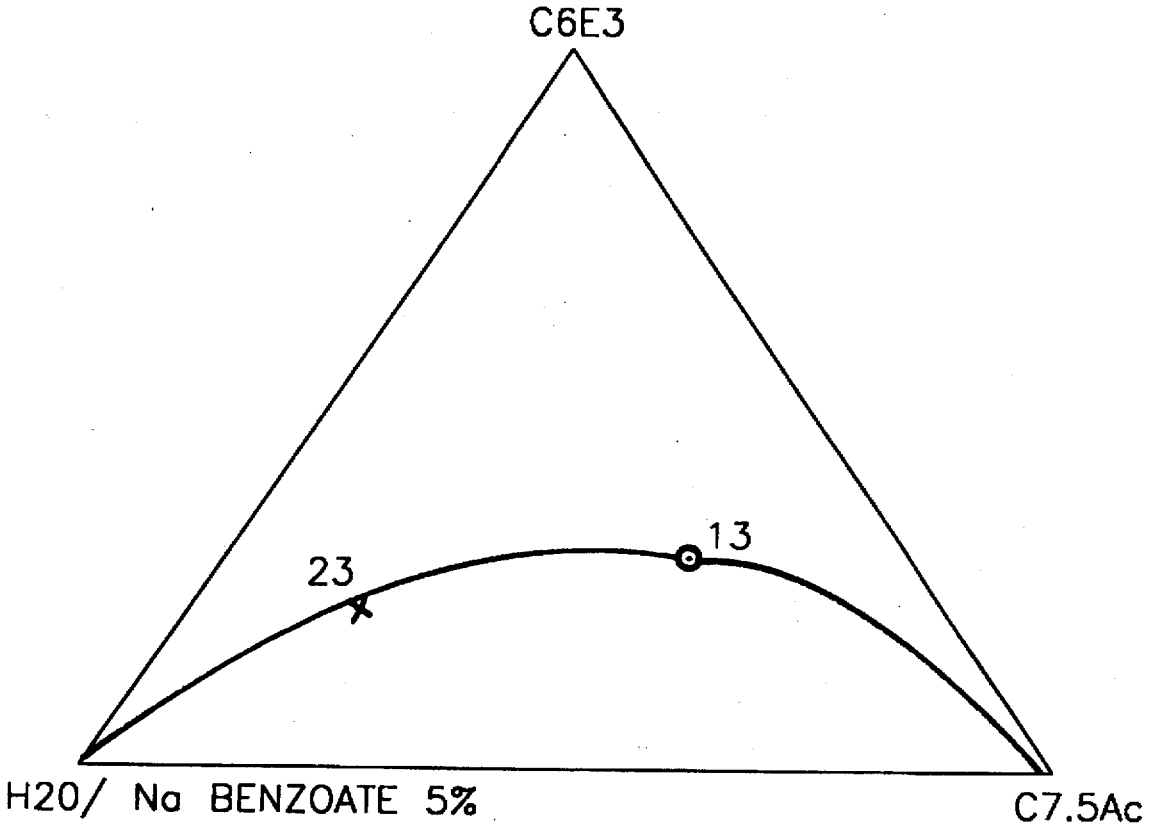
FIGS. 1 through 2 illustrate phase diagrams for the aqueous tricritical point compositions C and D of Example I.

The present invention relates to an aqueous near tricritical point composition having an apparent viscosity at $10^2$ $sec^{-1}$ and 25° C. of about 0.2 to about 1,000 cps, more preferably about 1 to about 100 cps, and a surface tension of about 10 to about 35 mN/m, which comprises approximately by weight:

a) 4 to 55% of a non-polar solvent or a weakly polar solvent or mixtures thereof, more preferably 15 to 50% and most preferably 25 to 45%;

b) 5 to 60%, more preferably 10 to 50% and most preferably 15 to 40%, of a water soluble or water low molecular weight dispersible amphiphile;

c) 20 to 50% and most preferably 20 to 40%, of a polar solvent, wherein the composition is optionally surfactant-free; and d) 0 to 20%, more preferably 0.5 to 15% and most preferably 1.0 to 10% of a water soluble additive, wherein the composition can optionally contain at least one solid particle and/or immiscible liquid whcih is not the nonpolar or weakly polar solvent in the composition.

The tricritical point compositions of the instant invention have three coexisting liquid phases that are capable of being converted into one single phase by weak mechanical action according to a reversible equilibrium or to make the three co-existing liquid phases merge together into one continuum to form the tricritical point composition.

In the following section, all mentions of wt. % concentrations ($X_1, X_2, X_3, X, Y_1, Y_2, Y_3, Z_1, Z_2, Z_3$) are expressed with reference to the whole composition and not reference to the considered singular phase. The wt. % concentration of the polar solvent in the first phase is represented by $X_1$ and the wt. % concentration of the polar solvent in the second phase is represented by $X_2$ and the wt. % concentration of the polar solvent in the third phase is represented by $X_3$, wherein the total wt. % concentration (X) of the polar solvent in the composition is equal to $X_1+X_2+X_3$, wherein $X_1$, $X_2$ and $X_3$ are approximately equal to each other. The concentration of the polar solvent can tolerate variations of ±5 absolute wt. % (i.e. with reference to the whole composition=100%), more preferably by ±2 absolute wt. % and most preferably ±1 absolute wt. % in each of the three phases. For example, if the total concentration of the polar solvent in the composition is 24 wt. %, the concentration of the polar solvent in each of the three phases is about 3 wt. % to about 13 wt. %, more preferably about 6 wt. % to 10 wt. % and most preferably about 7 wt. % to about 9 wt. %, wherein $X_1>X_2$ or $X_3$.

The wt. % concentration of the water soluble or water dispersible low molecular weight amphiphile in the first phase is represented by $Y_1$ and the wt. % concentration of the amphiphile in the second phase is represented by $Y_2$ and the wt. % concentration of the amphiple in the third phase is represented by $Y_3$, wherein the total wt. % concentration (Y) of the amphiple in the composition is equal to $Y_1+Y_2+Y_3$, wherein $Y_1$, $Y_2$ and $Y_3$ are approximately equal to each other. The concentration of the low molecular weight amphiphile can tolerate variations of ±5 absolute wt. %, more preferably ±2 absolute wt. % and most preferably ±1 absolute wt. % in each of the three phases. For example, if the total concentration of the low molecular weight amphiphile in the composition is 30 wt. %, the concentration of the polar solvent in each of the three phases is about 5 wt. % to about 15 wt. %, more preferably about 8 wt. % to 12 wt. % and most preferably about 9 wt. % to about 11 wt. %, wherein $Y_2>Y_1$ or $Y_3$.

The wt. % concentration of the non-polar solvent (also weakly polar solvent) in the first phase is represented by $Z_1$ and the wt. % concentration of the non-polar solvent in the second phase is represented by $Z_2$ and the wt. % concentration of the non-polar in the third phase is represented by $Z_3$, wherein the total wt. % concentration (Z) of the non-polar solvent in the composition is equal to $Z_1+Z_2+Z_3$, wherein $Z_1$, $Z_2$ and $Z_3$ are approximately equal to each other. The concentration of the nonpolar solvent can tolerate variations of ±5 absolute wt. %, more preferably ±2 absolute wt. % and most preferably ±1 absolute wt. % in each of the three phases. For example, if the total concentration of the low molecular weight amphiphile in the composition is 48 wt. %, the concentration of the polar solvent in each of the three phases is about 11 wt. % to about 21 wt. %, more preferably about 14 wt. % to 18 wt. % and most preferably about 15 wt. % to about 17 wt. %, wherein $Z_3>Z_1$ or $Z_2$.

The tricritical point compositions unlike true microemulsions which are optically clear exhibit a critical opalescence in that the tricritcal point composition appears opalescent.

When the tricritical point composition is at the tricritcal point the three phases merge into one single phase, wherein $X_1=X_2=X_3$ and $Y_1=Y_2=Y_3$ and $Z_1=Z_2=Z_3$ in the single phase.

The aqueous near tricritical point compositions of the instant invention can be used as a basic formulation for the production of both commercial and industrial applications by the incorporation of selective ingredients in the tricritical point composition. Typical compositions which can be formed for a variety of applications are oral compositions, cosmetics, hand creams, facial creams, eye shadows, lipsticks, metal polish agents, fabric cleaners, shampoos, floor cleaners, cleaning pastes, tile cleaners, bath tub cleaners, bleach compositions, ointments, oven cleaners, stain removers, fabric softeners, bleach pre-spotters, dishwashing prespotters, automatic dishwashing compositions, laundry pre-spotters, pharmaceutical compositions, coal slurries, oil drilling muds, and cleaning pre-spotters and graffiti or paint removers, mildew cleaner for grouts, flux removers for printed circuit boards, engine cleaners and degreasers, deinking compositions for printing machines and shoreline cleaners for shorelines contaminated by spilled crude oil as well as any composition containing an active ingredient which active ingredient has to be delivered into a cavity or a porous surface for either a cleaning mechanism or for the delivery of a medical use for medical treatment such as in treatment of oral diseases.

The present invention relates to a liquid cleaning composition which is optionally surfactant-free having a surface tension of about 10 to about 35 mN/m at 25° C. deriving from three co-existing liquid phases which are almost chemically identical to each other and the three co-existing liquid phases have merged together into one continuum to form the composition, wherein the first phase has the most polar solvent, the second phase has the most water soluble or water dispersible amphiphile and the third phase has the most non-polar solvent or weakly polar solvent and the interfacial tension between said first phase and said second phase is 0 to about $1\times10^{-3}$ mN/m and the interfacial tension between the second phase and the third phase is 0 to about $1\times10^{-3}$ mN/m, and the interfacial tension between the first phase and the third phase is 0 to about $1\times10^{-3}$ mN/m.

In a preferred composition, the polar solvent is water at a concentration of about 20 to about 50 wt %, the low molecular weight amphiphile is an organic compound having a water insoluble hydrophobic portion which has a partial Hansen polar parameter and hydrogen bonding parameter, both of which are less than about 5 $(MPa)^{1/2}$, and a water soluble hydrophilic portion which has a partial Hansen hydrogen bonding solubility parameter greater than about 10 $(MPa)^{1/2}$; the amphiphile is present at a concentration of about 5 to about 60 wt %; and non-polar solvent or weakly polar solvent has a Hansen dispersion solubility parameter greater than about 10 $(MPa)^{1/2}$ and a Hansen hydrogen bonding solubility parameter of less than about 15 $(MPa)^{1/2}$, being present at a concentration of about 4 to about 55 wt %.

The main characteristic of the polar solvent is that it has the ability to form hydrogen bonding with the low molecular weight amphiphile and the polar solvent has a dielectric constant of higher than 35. Besides water, other polar solvents suitable for use in the instant composition are formamide, glycerol, glycol and hydrogen peroxide and mixtures thereof. The aforementioned polar solvents can be mixed with water to form a mixed polar solvent system. The concentration of the polar solvent such as water in the near tricritical point composition is about 20 to 50 wt %, more preferably about 20 to about 40 wt %.

The organic non-polar or weakly polar solvent component of the present aqueous near tricritical point compositions includes solvents for the soils, is lipophilic, and is a suitable oil such as a non-polar oil which is preferably an aliphatic hydrocarbon of about 5 to about 25 carbon atoms and has the formula $C_nH_{2n+2}$, wherein n is 5 to 25, more preferably 6 to 16. Such an aliphatic hydrocarbon is desirably a normal paraffin or an isoparaffin and, of these, those which are saturated and of 6 to 16 carbon atoms are preferred, with isoparaffins of 8 to 18 carbon atoms being also preferred. The most preferred aliphatic hydrocarbon solvent is decane. The non-polar solvent or weakly polar solvent has a Hansen dispersion solubility parameter at 25° C. of at least 10 $(MPa)^{1/2}$, more preferably at least about 14.8 $(MPa)^{1/2}$, a Hansen polar solubility parameter of less than about 10 $(MPa)^{1/2}$ and a Hansen hydrogen bonding solubility parameter of less than about 15 $(MPa)^{1/2}$. In the selection of the non-polar solvent or weakly polar solvent, important parameters to be considered are the length and configuration of the hydrophobic chain, the polar character of the molecule as well as its molar volume.

The non-polar solvent or weakly polar solvent, which at 25° C. is less than 5 wt % soluble in water, is selected from the group consisting of alkanes and cycloalkanes having about 5 to about 25 carbon atoms, more preferably about 6 to about 16 carbon atoms; aryl alkyls having about 12 to 24 carbon atoms; terpenes having about 10 to about 40 carbon atoms, more preferably about 10 to about 30 carbon atoms; esters having the formula:

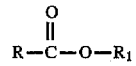

wherein R and $R_1$ are alkyl groups having together about 7 to about 24 carbon atoms, more preferably about 8 to about 20 carbon atoms, aromatic hydrocarbon oils and aliphatic hydrocarbon oils. Some typical non-polar solvents or weakly polar solvents are hexadecane, tetradecane, phenyl hexane, decylacetate, 2-undecanone, limonene, diethylene glycol monohexyl ether, disopropyl adipate, cetyl lactate and dioctyl maleate, and mixtures thereof.

The concentration of the non-polar solvent or weakly polar solvent in the near tricritical point composition is about 4 to about 55 wt %, more preferably about 15 to about 40 wt %.

The concentration of the low molecular weight amphiphile in the near tricritical point composition is about 5 to about 60 wt %, more preferably about 15 to about 40 wt %.

The low molecular weight amphiphile of the instant composition is a molecule composed of at least two parts which is capable of bonding with the polar solvent and the non-polar solvent. Increasing the molecular weight of the low molecular weight amphiphile increases its water/oil coupling ability which means less low molecular weight amphiphile is needed to couple the polar solvent and the non-polar solvent or weakly polar solvent. At least one part is essentially hydrophobic, with a Hansen partial polar and hydrogen bonding solubility parameters less than 5 $(MPa)^{1/2}$. At least one part is essentially water soluble, with Hansen partial hydrogen bonding solubility parameter equal or greater than 10 $(MPa)^{1/2}$.

To identify the hydrophilic and hydrophobic parts, the low molecular weight amphiphilic molecule (amphiphile) must be cut according to the following rules: The hydrophobic parts should not contain any nitrogen or oxygen atoms; the hydrophilic parts generally contain the hetero-atoms including the carbon atoms directly attached to an oxygen or nitrogen atom.

| Group | MW | $\delta_d$ | $\delta_p$ | $\delta_h$ |
|---|---|---|---|---|
| $—CH_2—OH$ | 31 | 15.5 | 16.1 | 25.4 |
| $—CH_2—NH_2$ | 30 | 13.8 | 9.3 | 16.7 |
| $—CO—NH_2$ | 44 | 13 | 14.1 | 13.4 |
| $—CH_2—NH—CO—NH_2$ | 73 | 13.7 | 11.4 | 13.6 |
| $—CH_2—EO—OH$ | 75 | 14.9 | 3.1 | 17.5 |
| $—CH_2—EO_2—OH$ | 119 | 14.8 | 2.6 | 14.8 |
| $—CH_2—EO_3—OH$ | 163 | 14.7 | 2.1 | 13.3 |
| $—CH_2—EO_4—OH$ | 207 | 14.7 | 1.9 | 12.4 |
| $—COO—CH_3$ | 59 | 13.7 | 8.3 | 8 |
| $—CO—CH_3$ | 43 | 16.5 | 17.9 | 6.8 |
| $—C_3H_7$ | 43 | 13.7 | 0 | 0 |
| $—C_4H_9$ | 57 | 14.1 | 0 | 0 |
| $—C_{10}H_{21}$ | 141 | 15.8 | 0 | 0 |

This table shows the solubility parameters for different groups. The first series can be used as the hydrophilic part of an amphiphile molecule, as the hydrogen bonding solubility parameter is always greater than 10. The last group can be used as the hydrophobic part of an amphiphile, as their polar and hydrogen bonding solubility parameters are below 1. The group in the middle (esters and ketones) cannot be used as a significant contribution to an amphiphile molecule. It is noteworthy that amphiphiles can contain ketone or ester functions, but these functions do not contribute directly to the amphiphile performance. $\delta_d$ is the Hansen dispersion solubility parameter as measured at room temperature; $\delta_p$ is the Hansen polar solubility parameter as measured at room temperature; $\delta_h$ is the Hansen hydrogen bonding solubility parameter as measured at room temperature. In particular preferred low molecular weight amphiphiles, which are present at a concentration of about 5 to about 60 wt %, more preferably about 15 to about 40 wt %, are selected from the group consisting essentially of polyoxyethylene derivatives having the formula:

$$C_xH_{2x+1}—O—(CH_2CH_2—O—)_y—H$$

wherein x and/or y is 1 to 6, more preferably 1 to 6, polyols having 4 to 8 carbon atoms, polyamines having 5 to 7 carbon atoms, polyamides having 5 to 7 carbon atoms, alkanols having 2 to 4 carbon atoms and alkylene glycol alkyl ethers having the formula:

$$R''—O—(CH_2\overset{\overset{CH_3}{|}}{\underset{\underset{(CH_2)_x}{|}}{C}}H—O)_yH$$

wherein R" is an alkylene group having about 1 to about 8 carbon atoms and x is 0 to 2 and y is about 1 to about 5. The molecular weight of the low molecular weight amphiphile is about 76 to about 300, more preferably about 100 to about 250. Especially preferred low molecular weight amphiphiles are propylene glycol n-butyl ether, tripropylene glycol n-butyl ether, propylene glycol t-butyl ether, propylene glycol methyl ether, hexanediol, diethylene glycol monobutyl ether, triethylene glycol monohexyl ether and tetraethylene glycol monohexylether and mixtures thereof such as propylene glycol n-butyl ether and propylene glycol methyl ether in a ratio of about 2:1 to about 1.5:1.

The near tricritical point compositions formed from the previously described low molecular weight amphiphiles are surfactant free because these previously described low molecular weight amphiphiles are not classified as surfactants.

However, near tricritical point compositions can be optionally formed from a polar solvent, a non-polar or weakly polar solvent and a surfactant on a mixture of a low molecular weight amphiphile and surfactant, when the surfactant is employed without a low molecular weight amphiphile, the surfactant is present in the composition at a concentration of about 5.0 to about 25.0 wt. percent. When the surfactant is employed in the composition with the low molecular weight amphiphile the concentration of the surfactant is about 0.1 to about 25 weight percent and the concentration of the low molecular weight amphiphile is about 5 to about 60 wt. percent. The surfactants that are employed in the instant invention are selected from the group consisting of nonionics, anionics, amine oxides, cationics and amphoteric surfactants and mixtures thereof. When the surfactant is used alone and without a low molecular weight amphiphile the surfactant must preferably have an HLB of about 7 to 14. It is to be understood that surfactants are a subset of the set of amphiphiles. The low molecular weight amphiphiles do not form aggregates at an interface for example, the interface of oil and water, but rather the low molecular weight amphiphile is evenly distributed throughout the solution. Whereas a surfactant is prone to concentrate at the interfaces between different phases (air/liquid; liquid/liquid; liquid/solid) thereby forming aggregates at the interface and decreasing the interfacial tension between the above coexisting phases. For example a surfactant will form aggregates at an oil/liquid interface and the surfactant will not be evenly distributed throughout the solution.

The instant compositions can also optionally include besides the polar solvent, the non-polar or weakly polar solvent and the water dispersible amphiphile, a water soluble acid at a concentration of about 0.1 to 15.0 wt. percent, more preferably about 1 to 10 wt. percent.

The active acidic component of the near tricritical point composition can optionally be a carboxylic acid which is strong enough to lower the pH of the near tricritical point composition to the range of one to four. Various carboxylic acids can perform this function, but those which have been found effective to remove soap scum and lime scale from bathroom surfaces, while still not destabilizing the composition, are polycarboxylic acids, and of these the dicarboxylic acids are preferred. Of the dicarboxylic acids group, which includes those of 2 to 10 carbon atoms, from oxalic acid through sebacic acid, suberic, azelaic and sebacic acids are of lower solubilities and therefore are not as useful in the present near tricritical point composition as the other dibasic aliphatic fatty acids, all of which are preferably saturated and straight chained. Oxalic and malonic acids, although useful as reducing agents too, may be too strong for delicate hard surface cleanings. Preferred such dibasic acids are those of the middle portion of the 2 to 10 carbon atom acid range, succinic glutaric, adipic and pimelic acids, especially the first three thereof, which fortunately are available commercially, in mixture. The diacids, after being incorporated in the invented near tricritical point composition may be partially neutralized to produce the desired pH in the near tricritical point composition for greatest functional effectiveness, with safety. Citric acid can also be considered as a suitable carboxylic acid.

Phosphoric acid is one of the additional acids that helps to protect acid-sensitive surfaces being cleaned with the present. Being a tribasic acid, it too may be partially neutralized to obtain a composition pH in the desired range. For example, it may be partially neutralized to the biphosphate, e.g., $NaH_2PO_4$, or $NH_4H_2PO_4$.

Phosphonic acid, the other of the two additional acids for protecting acid-sensitive surfaces from the dissolving action of the dicarboxylic acids of the present compositions, apparently exists only theoretically, but its derivatives are stable and are useful in the practice of the present invention. Such are considered to be phosphonic acids, as that term is used in the specification. the phosphonic acids are of the structure:

$$Y—\overset{\overset{OH}{|}}{\underset{\underset{OH}{|}}{P}}=O$$

wherein Y is any suitable substituent, but preferably Y is alkylamino or N-substitued alkylamino. For example, a preferred phosphonic acid component of the present compositions is aminotris-(methylenephosphonic) acid, which is of the formula $N(OH_2PH_2O_3)$. Among other useful phosphonic acids are ethylenediamine tetra-(methylenephosphonic) acid, hexamethylenediamine tetra-(methylenephosphonic) acid, and diethylenetriamine penta-(methylenephosphonic) acid. Such class of compounds may be described as aminoalkylenephosphonic acids containing in the ranges of 1 to 3 amino nitrogens, 3 or 4 lower alkylenephosphonio acid groups in which the lower alkylene is of 1 or 2 carbon atoms, and 0 to 2 alkylene groups of 2 to 6 carbon atoms each, which alkylene(s) is/are present and join amino nitrogens when a plurality of such amino nitrogens is present in the aminoalkylene phosphonic acid. It has been found that such aminoalkylenephosphonio acids which also may be partially neutralized at the desired pH of the near tricritical point composition, are of desired stabilizing and protecting effect in the invented cleaner, especially when present with phosphoric acid, preventing harmful attacks on European enamel surfaces by the diacid(s) components of the cleaner. Usually the phosphorus acid salts, if present, will be mono-salts of each of the phosphoric and/or phosphonic acid groups present.

Of all the organic acids which are of sufficient acidity effectively to attack soap scum and to convert it to a form which is readily removable from hard surfaces, such as ceramic tiles, Portland cement and acrylic latex grouts between the tiles, porcelain, porcelain enamel, glass, fiberglass and metal (such as chrome and nickel plated) surfaces, glutaric acid or a partially neutralized salt or ionized form thereof is highly preferred, because it performs effectively and has no significantly detrimental negative properties, but in some instances other acids capable of converting calcium and magnesium higher fatty acid soaps to acidic or partially neutralized form to assist in removing them from hard surfaces which they are staining (in the form of soap scum) may also be employed (when detrimental properties thereof, if any, are tolerable). Such acids will include those which do not form water insoluble calcium salts. For example, acetic acid, succinic acid, propionic acid and citric acid may be utilized in some circumstances. However, citric acid is a sequestering acid and tends to remove calcium from calcium carbonate in the grout employed between adjacent ceramic tiles, which is detrimental to its use, and the other mentioned acids are often unsatisfactory because of unacceptable odors and/or because they result in human nasal and/or respiratory irritation. Of course, those acids which are toxic under the circumstance of use will also preferably be avoided. Therefore, glutaric acid is preferably utilized as such soap scum attacking acid. It may be (and usually is) subsequently partially neutralized to the desired pH range during manufacture of the invented cleaner but it is also within the invention to employ salts of such acid and to convert them to the desired pH, it being recognized that the products of both such operations are the same. Therefore, by reference to "partially neutralized glutaric acid" it is meant also to include such products resulting from partially acidifying glutaric acid salts (glutarates) of from directly incorporating the partially neutralized glutarates of desired pH with the other components of the cleaner.

The instant composition can optionally contain about 0.1 to about 15 wt %, more preferably about 1 to about 5 wt % of a water soluble chaotropic additive which can be hydrotropic or kosmotropic. A hydrotropic agent weakens (salting-in effect) the structure of the water thereby making the water an improved solvent for the amphiphile, whereas a kosmotropic (lyotropic) agent strengthens (salting-out effect) the structure of the water thereby making water less of a solvent for the amphiphile. Typical hydrotropic agents are acetic acid, ethanol, isopropanol, sodium benzoate, sodium toluene sulfonate, sodium xylene sulfonate, ethylene glycol, propylene glycol, metal salts of iodide, metal salts of thiocyanates, metal salts of perchlorates, guanidimium salts. The use of the chaotropic additive can change the weight percentage of the polar solvent, amphiphile and non-polar solvent used to form the near tricritical point composition.

In addition to the recited components of the aqueous near tricritical point compositions of the present invention, there may also be present adjuvant materials for dental, dishwashing, laundering and other detergency applications, which materials may include: foam enhancing agents such as lauric or myristic acid diethanolamide; foam suppressing agents (when desired) such as silicones, higher fatty acids and higher fatty acid soaps; preservatives and antioxidants such as formalin and 2,6-ditert-butyl-p-cresol; pH adjusting agents such as sulfuric acid and sodium hydroxide; perfumes; and colorants (dyes and pigments).

The instant compositions can optionally contain an inorganic or organic builder salt provided that the salt is not present at a concentration that destroys the character of the tricritical point compositions. The builder salt is generally present at a concentration of about 1 to about 20 wt. %, more preferably about 2 to about 10 wt. %. The builder salt is selected from the group consisting of isoserine diacetate acid, alkali metal carbonates, alkali metal bicarbonates, alkali metal citrates, alkali metal salts of a polyacrylic acid having a molecular weight of about 500 to 4,000, alkali metal tartarates, alkali metal gluconates, alkali metal silicates, alkali metal tripolyphosphates and alkali metal pyrophosphates and mixtures thereof. The maximum concentration of the builder salt in the tricritical point composition is determined by and limited by the solubility of the builder salt in the water phase, wherein the builder salt is completely dissolved in the water phase.

The aqueous near tricritical point compositions can be used in forming cleaning compositions containing enzymes and/or bleachants such as fabric detergent compositions or automatic dishwashing compositions which can contain bleachants, at least one enzyme, and a suitable phosphate or non-phosphate builder system.

A typical cleaning composition comprises:

| | |
|---|---|
| $H_2O$ | 19.24% |
| Na Benzoate | 1.0% |
| Triethylene glycol hexyl ether | 32.5% |
| Heptylacetate | 35.44% |
| Nonylacetate | 11.81% |

The variations in formulas of compositions within the invention which are in the tricritical or near tricritical state are easily ascertainable, and the invention is readily understood when reference is made to this specification, including the working examples thereof, taken in conjunction with the phase diagrams.

Figure 2:
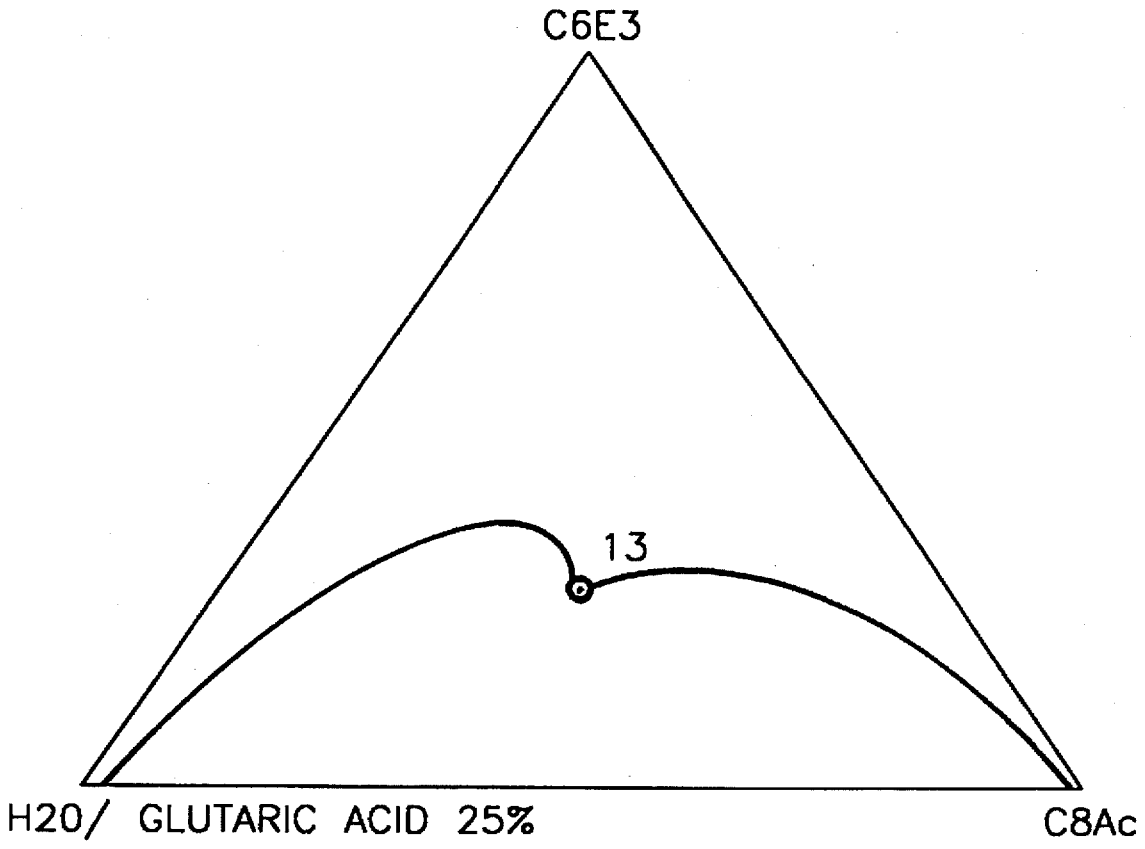

FIGS. 1–2 are phase diagrams of compositions C and D of example 1, wherein 13 designates the tricritical point compositions. For illustration, the composition at point 23 marked by an "x" on FIG. 1 comprises 56.25 wt. % of a 5% Na benzoate solution in water, 25 wt. % of triethyleneglycol monohexyl ether and 18.15 wt. % of oil (mixture of heptylacetate/nonylacetate 3:1 ratio).

In the previous description of the components of the invented compositions and proportions thereof which may be operative, boundaries were drawn for preferred compositions within the invention, but it will be evident that one seeking to manufacture the invented near tricritical point compositions will select proportions of components indicated by the phase diagrams for the particular compositions, so that the desired compositions will be within the near tricritical area. Similarly, the tricritical point compositions selected should be such that upon contact with water, the lipophilic soil will be removed from a substrate.

For plotting of the phase diagrams and in experiments undertaken by the inventors to establish the formulas of the desired tricritical point compositions, many different compositions within the invention were made and were characterized.

To make the near tricritical point compositions of the invention is relatively simple because they tend to form spontaneously with little need for the addition of energy to promote transformation of the tri critical state. However, to promote uniformity of the composition, mixing will normally be undertaken and it has been found desirable, but not compulsory, to first mix the amphiphile and water together, followed by admixing of the non-polar solvent or weakly solvent component. It is not usually necessary to employ heat and most mixings are preferably carried out at about 20°–25° C. or higher.

Pre-spotting and manual cleaning uses of the invented near tricritical point compositions are uncomplicated, requiring no specific or atypical operations. Thus, such near tricritical point compositions may be employed in the same manner as other liquid pre-spotting and detergent compositions.

The invented near tricritical point compositions may be applied to such surfaces by pouring onto them, by application with a cloth or sponge, or by various other contacting means, but it is preferred to apply them, depending on their viscosity, in the form of a spray by spraying them onto the substrate from a hand- or finger-pressure operated sprayer or squeeze bottle. Such application may be applied onto hard surfaces such as dishes, walls or floors from which lipophilic (usually greasy or oily) soil is to be removed, or may be applied onto fabrics such as laundry which has previously been stained with lipophilic soils such as motor oil. The invented compositions may be used as detergents and as such may be employed in the same manner in which liquid detergents are normally utilized in dishwashing, floor and wall cleaning, and laundering, but it is preferred that they are employed as pre-spotting agents too, in which applications they are found to be extremely useful in loosening the adhesions of lipophilic soils to substrates, thereby promoting much easier cleaning with application of more of the same invented detergent compositions or by applications of different commercial detergent compositions in liquid, bar or particulate forms.

EXAMPLES

The following examples illustrate but do not limit the invention. Unless otherwise indicated, all parts in these examples, in the specification and in the appended claims are by weight percent and all temperatures are in °C.

The formulas A through G were prepared according to the following procedure:

| | Example 1 | | | | | | |
|---|---|---|---|---|---|---|---|
| COMPOSITION | A | B | C | D | E | F | G |
| Water | 30.5 | 27 | 19.38 | 25.31 | 40.7 | 35.71 | 33.03 |
| Diethylene glycolbutylether | 39 | | | | | | |
| Triethylene glycolhexylether | | | 32 | 32.5 | | 28.57 | 33.94 |
| Ethanol | | 15.33 | | | | | |
| Propanol | | 30.67 | | | | | |
| Dobanol91-25 | | | | | 5.58 | | |
| Dobanol91-5 | | | | | 8.37 | | |
| Heptylacetate | | | 35.7 | 16.875 | | | |
| Nonylacetate | | | 11.9 | 16.875 | | | |
| Decylacetate | 30.5 | | | | | | |
| Tridecylacetate | | 27 | | | | | |
| 4-Heptanone | | | | | | | 33.03 |
| 2-Undecanone | | | | | | 35.71 | |
| Octane | | | | | 42.84 | | |
| Glutanic acid | | | | 8.44 | | | |
| Sodiumbenzoate | | | 1.02 | | | | |
| Acetic acid 1 M solution | | | | | 0.37 | | |
| Isoserine diacetic acid, sodium salt | | | | | 2.14 | | |
| Viscosity (25° C., 100 $sec^{-1}$, Pa sec.) | $7 \times 10^{-3}$ | $4 \times 10^{-3}$ | $8 \times 10^{-3}$ | $1 \times 10^{-2}$ | $5 \times 10^{-3}$ | $8 \times 10^{-3}$ | $6 \times 10^{-3}$ |
| Surface tension (mN/m) | 25.8 | 25.1 | 25.5 | 26.5 | 21.3 | 26.5 | 25.9 |
| Soil removal performance (*) | | | | | | | |
| Tar soil | XX | X | XXX | XX | XX | XXX | XXX |
| Greasy soil | XXX | XXX | XXX | XXX | XXX | XXX | XXX |
| Soap scum | XX | X | XX | XXX | XX | XX | XX |

(*)The performance is estimated as the extent the soil is removed after having poured a few drops of the composition on the soil, let it work during about one minute without any mechanical action and rinsed it with water.
XXX = completely removed
XX = partially removed
X = hardly removed Compositions A through G were made by first forming with mixing at room temperature a solution of the amphiphile and the water or the water and additive. To this solution at room temperature was added with mixing the non-polar solvent(oil) or weakly polar solvent to form the near tricritical point compositions A through G. The apparent viscosity measurements were made at 25° C. on a Carrimed. The surface tension measurements were carried out at 25° C. on a Lauda.

EXAMPLE 2

The following glass cleaning composition with spontaneous spreading, low draining and low residue was made according the procedure of example I:

| | Wt. % |
|---|---|
| Water | 47.6 |
| Isopropyl alcohol | 47.6 |
| Propylene glycol | 4.8 |

-continued

| | Wt. % |
|---|---|
| tert-butyl ether | |
| Viscosity (25° C. 100 sec-1, mPa. sec.): 3.3 $10^{-3}$ | |
| Surface tension (mN/m): 23.6 | |
| Spreading: 24 mm | |
| Draining length: 90. mm | |

The spreading is expressed as the diameter that a 10 μl droplet of the composition reaches 30 seconds after having been deposited on a clean horizontal glass surface. Under these conditions, pure water shows a spreading of 6 mm. The draining effect is expressed as the total length that a 10 μl droplet-of the composition covers after having been deposited on a clean vertical glass surface. Under these conditions, pure water gives a draining length of 490 min.

The invention has been described with respect to various embodiments and illustrations of it but is not to be considered as limited to these because it is evident that one of skill in the art with the present specification before him/her will be able to utilize substitutes and equivalents without departing from the invention.

What is claimed is:

1. A liquid cleaning composition having a surface tension at 25° C. of about 10 to 35 mN/m and incorporating at least a polar solvent, a water soluble or water dispersible low molecular weight amphiphile and a non-polar or weakly polar solvent and deriving from three co-existing liquid phases which are capable of being converted into one single phase according to a reversible equilibrium, wherein the first phase is the most abounding with the polar solvent, the second phase is the most abounding with the water soluble or water dispersible low molecular weight amphiphile and the third phase is the most abounding with the non-polar solvent or weakly polar solvent, and the interfacial tension between said first phase and said second phase is 0 to about $1\times10^{-3}$ mN/m, and the interfacial tension between second phase and third phase is 0 to about $1\times10^{-3}$ mN/m, and the interfacial tension between first phase and third phase is 0 to about $1\times10^{-3}$ mN/m, wherein said polar solvent is at a concentration of about 20 wt. % to about 50 wt. %, said amphiphile is present at a concentration of about 5 to about 60 wt. %, said composition being surfactant free and said non-polar solvent or weakly polar solvent is present at a concentration of about 4 to about 55 wt. %.

2. A composition according to claim 1, wherein the amphiphile is an organic compound having a water insoluble hydrophobic portion which has a partial polar parameter and hydrogen bonding parameter, both of which are less than about 5 $(MPa)^{1/2}$, and a water soluble hydrophilic portion which has a partial hydrogen bonding solubility parameter greater than about 10 $(MPa)^{1/2}$; and said non-polar solvent or weakly polar solvent having a dispersion solubility parameter greater than about 10 $(MPa)^{1/2}$ and a hydrogen bonding solubility parameter of less than about 15 $(MPa)^{1/2}$.

3. A composition according to claim 2, wherein said low molecular weight amphiphile is selected from the group consisting essentially of alkylene glycol alkyl ethers, polyoxyethylene derivatives having the formula:

$$C_xH_{2x+1}—O—(CH_2CH_2—O—)_y—H$$

wherein x or y is 1 to 6, polyols having about 4 to about 8 carbon atoms, polyamines having about 5 to about 7 carbon atoms, polyamides having about 5 to about 7 carbon atoms, and alkanols having about 2 to about 4 carbon atoms.

4. A composition according to claim 3, wherein said non-polar solvent or weakly polar solvent is selected from the group consisting of alkanes and cycloalkanes having about 5 to about 25 carbon atoms, aryl alkanes having about 12 to about 24 carbon atoms, aliphatic hydrocarbon oils and aromatic hydrocarbon oils having about 6 to about 14 carbon atoms, terpenes having about 10 to about 40 carbon atoms, and esters having the formula:

$$RC(=O)OR_1$$

wherein R and $R_1$ are alkyl groups having together about 7 to about 24 carbon atoms.

5. A composition according to claim 1, wherein said non-polar solvent or weakly polar solvent is an aliphatic hydrocarbon having 6 to 16 carbon atoms and is present in the composition at a concentration of 4 to 55 wt %.

6. A composition according to claim 1, wherein said polar solvent is water and is present in the composition at a concentration of 20 to 40 wt %.

7. A composition according to claim 1, wherein said composition is sprayable by a hand operated pump sprayer.

8. A composition according to claim 6, wherein said non-polar solvent or weakly polar solvent is an aliphatic hydrocarbon having about 6 to about 16 carbon atoms.

9. A composition according to claim 8, wherein said low molecular weight amphiphile is triethylene glycol monohexyl ether.

10. A composition according to claim 6, wherein said amphiphile is triethylene glycol monohexyl ether.

* * * * *